US006123744A

United States Patent [19]

Huzinec

[11] Patent Number: 6,123,744

[45] Date of Patent: Sep. 26, 2000

[54] VITREOUS BOND COMPOSITIONS FOR ABRASIVE ARTICLES

[75] Inventor: Gary M. Huzinec, Cincinnati, Ohio

[73] Assignee: Milacron Inc., Cincinnati, Ohio

[21] Appl. No.: 09/324,199

[22] Filed: Jun. 2, 1999

[51] Int. Cl.[7] ..... B24D 3/02; B24D 3/04; B24D 3/14

[52] U.S. Cl. ..... 51/307; 51/309; 51/293

[58] Field of Search ..... 51/307, 309, 308, 51/293, 295

[56] References Cited

U.S. PATENT DOCUMENTS

| | | | |
|---|---|---|---|
| 3,852,049 | 12/1974 | Hibbs, Jr. et al. | 51/308 |
| 3,986,847 | 10/1976 | Balson | 51/307 |
| 4,076,506 | 2/1978 | Valdsaar | 51/307 |
| 4,132,534 | 1/1979 | Valdsaar | 51/307 |
| 4,374,651 | 2/1983 | Lee | 51/309 |
| 4,867,758 | 9/1989 | Newkirk | 51/293 |
| 5,094,672 | 3/1992 | Giles, Jr. et al. | 51/307 |
| 5,178,644 | 1/1993 | Huzinec | 51/293 |
| 5,203,886 | 4/1993 | Sheldon et al. | 51/309 |
| 5,213,592 | 5/1993 | Newkirk | 51/309 |
| 5,282,875 | 2/1994 | Wood et al. | 51/298 |
| 5,318,605 | 6/1994 | Carman | 51/308 |
| 5,401,284 | 3/1995 | Sheldon et al. | 51/308 |
| 5,536,282 | 7/1996 | Yoon et al. | 51/293 |
| 5,536,283 | 7/1996 | Sheldon et al. | 51/308 |
| 5,607,489 | 3/1997 | Li | 51/307 |
| 5,711,774 | 1/1998 | Sheldon | 51/307 |
| 5,876,470 | 3/1999 | Abrahamson | 51/307 |

FOREIGN PATENT DOCUMENTS

| | | | |
|---|---|---|---|
| 526262 | 12/1995 | European Pat. Off. | B24B 37/04 |
| 786506 | 7/1997 | European Pat. Off. | C09K 3/14 |

OTHER PUBLICATIONS

Derwent Acc–No. 1996–420697, Derwent week 199952 which is based on JP 08206962 A, Aug. 1996.

Abstract of German patent DE 4119183, Nov. 1992.

Abstract of European Patent Publication No. 311264–A Sep. 1988.

Patent Abstracts of Japan (Abs. No. 04–354801 of JP Appl. No. 03–155760 filed May 30, 1991.

Patent Abstracts of Japan (Abs. No. 07–246562 of Appl. No. 06–65752 filed Mar. 9, 1994.

Inorganic Chemistry: An Advanced Textbook, Therald Moeller, at pp. 769–773 (no date).

*Primary Examiner*—Michael Marcheschi
*Attorney, Agent, or Firm*—John W. Gregg; Donald Dunn

[57] ABSTRACT

Bonded abrasive articles are described wherein a metal boride modified, lead-free vitreous matrix binds abrasive grains, such abrasive articles demonstrate improved performance over vitreous bonded abrasive articles with known vitreous matrices. Vitreous bond precursor materials are described including admixtures comprising lead-free vitreous precursor material and powder of metal boride(s), and admixtures comprising metal boride modified, lead-free vitreous particles. Methods are described for producing vitreous bonded abrasive articles having abrasive grains bound by metal boride modified, lead-free vitreous matrices.

27 Claims, No Drawings

VITREOUS BOND COMPOSITIONS FOR ABRASIVE ARTICLES

FIELD OF INVENTION

This invention relates to vitreous bonded abrasive articles, more particularly grinding wheels. The invention further pertains to admixtures for producing improved vitreous bonded abrasive articles. More particularly the invention pertains to improved vitreous bonded grinding wheels, methods for making improved vitreous bonded grinding wheels and vitreous bond precursors for producing improved vitreous bonded grinding wheels.

BACKGROUND

Vitreous bonded abrasive grinding wheels, as well as other vitreous bonded abrasive articles (e.g. honing stones), have been known in the art for a long time. Such wheels and articles have long been the subject of efforts to improve both materials and methods for their manufacture to gain greater grinding performance, higher utility, greater life and improved economics. Improved abrasive grains and methods for their production, as well as improvements in the composition and properties of vitreous bond materials have resulted in greater grinding performance, lower cost, improved work products and greater wheel life in many cases. However, increases in utility and performance continue to be sought, particularly as advances in technology place ever greater demands on precision, accuracy and performance of devices and their ground component parts and increased competition places ever greater emphasis on economic advantages in wheel performance and grinding operations.

Essentially, a vitreous bonded grinding wheel and other vitreous bonded abrasive articles, have abrasive grain or grit, e.g. alumina abrasive, bonded together by a vitreous material. Other functional materials, such as for example, solid lubricants, grinding aids, extreme pressure agents and hollow fillers ("bubbles"), sometimes are included in the wheel or article. In the typical known method of making a vitreous bonded abrasive grinding wheel or article, abrasive grain, bond precursor (e.g. frit or other vitrifiable materials), temporary binder (e.g. aqueous phenolic resin binder), and, selectively, other functional materials and/or pore inducers, are blended together to form a uniform mixture. This mixture is then placed in a mold generally defining size and shape of the article and compacted into a self-supporting article held together by the temporary binder. This compact, or "green" article is dried and then placed in a kiln to be heated, i.e. fired, under a particular cycle of time, temperature and atmosphere to burn off the temporary binder and any organic pore inducer present and to vitrify the bond precursor. The heating cycle depends upon the composition of the wheel or article and may vary with the abrasive grain, the composition of the vitrifiable material, the additives used and the size and shape of the wheel.

It is known in the art to produce vitreous bonded grinding wheels of different grades tailored to meet particular grinding conditions and requirements. These grades are broadly characterized from soft to hard. Thus grinding a soft metal workpiece (e.g. copper, aluminum) often required a wheel grade different (e.g. softer) than a wheel for grinding a hard or tough metal workpiece (e.g. nickel, stainless steel). The grade of the wheel is dependent upon a number of manufacturing, chemical and physical factors including but not limited to firing conditions; the composition of the abrasive grain; grain size; grain concentration in the wheel; vitreous bond matrix composition; concentration of vitreous bond matrix in the wheel; porosity of the wheel; pore size; and adhesion between the grain and vitreous bond matrix. These different grades can exhibit different physical properties and different grinding performance. Notwithstanding variations among grades, improved grinding performance is sought for all grades of vitreous bonded abrasive grinding wheels. Particular performance improvements include, for example, increased retention of wheel forms such as are used to produce contours in finished workpieces, reduced frequency of wheel dressing to maintain desired cutting performance, improved wheel life, increased metal removal rate, increased grinding ratio and lower power consumption.

As previously noted, practitioners in the art have sought performance improvements through variations in the composition of the vitrifiable material for producing the vitreous bond matrix. Such changes affect the strength of the bond retaining the abrasive. A vitreous bond matrix that is too strong can prevent or reduce the occurrence of grain fracture, a mechanism by which new sharp cutting edges are produced during use. Reduced occurrence of grain fracture can result in reduced metal removal and workpiece burning (i.e. surface discoloration) of metallic workpieces. On the other hand a vitreous bond matrix too weak can lead to premature grain loss during grinding, resulting in increased wheel wear and consequent low grinding ratio (i.e. ratio of volume of metal removed to volume of wheel lost during a grinding period).

SUMMARY OF INVENTION

It is an object of this invention to provide a vitreous bond precursor-abrasive admixture for use in making improved vitreous bonded abrasive articles.

Another object of this invention is to provide a method for making improved vitreous bonded abrasive articles.

A further object of this invention is to provide an improved vitreous bonded abrasive grinding wheel.

A still further object of this invention is to overcome disadvantages of prior art vitreous bonded abrasive grinding wheels and methods for making vitreous bonded abrasive grinding wheels.

These and other objects of this invention will be made evident in the following description, examples and claims. The above objects and others, as will be apparent to those skilled in the art from the following description, examples and claims, are achieved in this invention by use of a vitreous bond precursor-abrasive admixture for producing a vitreous bonded abrasive article having a metal boride modified, lead-free, vitreous matrix binding the grains of the abrasive. Aspects of the invention include such admixtures, methods of making such vitreous bonded abrasive articles, and vitreous bonded abrasive articles having metal boride modified, lead-free, vitreous bonds binding the abrasive.

DESCRIPTION OF INVENTION

It has been known in the art to employ metal borides (e.g. tungsten pentaboride and zirconium diboride) fillers in lead containing vitreous bonded cubic boron nitride grinding wheels fired in a non-oxidizing atmosphere, particularly, nitrogen. However, it is also known in the same art that firing the same metal boride filler containing wheels in an oxidizing atmosphere produces: a) vitreous bonds exhibiting signs of undesirable reaction (e.g. gas holes, friability, porosity and differences between the surface and interior of the bond); and, b) grinding wheels having poor grinding performance (e.g. low grinding ratio).

It has however been unexpectedly discovered that metal boride modification of a lead-free vitreous bond produces an abrasive article having improved physical properties and exhibiting improved grinding performance as compared to abrasive articles having an unmodified vitreous bond where the bond precursor is modified by the metal boride by firing in an oxidizing atmosphere. Thus in keeping with this discovery there is provided in accordance with this invention a method for making an improved vitreous bonded abrasive article, an improved vitreous bonded abrasive article, and a vitreous bond precursor-abrasive admixture for producing an improved vitreous bonded abrasive article.

There has now been discovered in one aspect of the invention a method of producing a vitreous bonded abrasive article comprising: (i) preparing an admixture comprising a lead-free vitreous bond precursor material, at least one metal boride powder, and an abrasive grain; (ii) forming a green abrasive article with said admixture; and, (iii) firing the green article in an oxidizing atmosphere (e.g. air).

Further, there has now been discovered in another aspect of the invention, a method of producing a vitreous bonded abrasive article comprising: (i) preparing an admixture comprising a metal boride modified, lead-free, vitreous particulate material and an abrasive grain; (ii) forming a green abrasive article with said admixture; and, (iii) firing the green abrasive article to produce a vitreous bonded abrasive article.

Further, there has now been discovered in another aspect of the invention, an improved vitreous bond precursor-abrasive admixture comprising, in mixture, a lead-free vitreous bond precursor material, a metal boride powder, and abrasive grain.

Further, there has now been discovered in another aspect of the invention, an improved vitreous bond precursor-abrasive admixture comprising, in mixture, a metal boride modified, lead-free, vitreous particulate material and an abrasive grain.

A still further aspect of this invention is an improved vitreous bonded abrasive article made by (i) forming an article from a vitreous bond precursor-abrasive admixture; and (ii) firing the formed article to produce an article having a metal boride modified, lead-free, vitreous matrix binding grains of the abrasive. Such vitreous bonded abrasive article exhibiting improved grinding performance and improved physical properties (e.g. vitreous bond strength) over a comparably made abrasive article made without metal boride modified, lead-free, vitreous bond.

A still further aspect of this invention is an improved vitreous bonded abrasive article made by (i) forming an article from a vitreous bond precursor-abrasive admixture comprising a lead-free vitreous bond precursor, a metal boride powder and abrasive grain; and (ii) firing the formed article in an oxidizing atmosphere to produce an abrasive article having a lead-free, metal boride modified vitreous matrix binding the abrasive grain.

A still further aspect of this invention is an improved vitreous bonded abrasive article made by (i) forming an article from an admixture comprising metal boride modified, lead-free, vitreous particulate material and abrasive grain; and (ii) firing the formed article to produce an abrasive article having a lead-free, metal boride modified vitreous matrix binding the abrasive grain.

The various aspects of this invention will now be described with reference to specific embodiments and examples thereof.

The lead-free vitreous bond precursor employed in this invention is the material or mixture of materials which when heated in the firing step forms a vitreous bond or matrix that binds together the abrasive grains of the abrasive article. This vitreous bond, binding together the abrasive grains is also known in the art as the vitreous matrix, vitreous phase, ceramic bond or glass bond of the abrasive article. The lead-free vitreous bond precursor may be more particularly a combination or mixture of oxides and silicates that upon being heated to a high temperature react to form a vitreous bond or matrix or a glass or ceramic bond or matrix. Alternatively the lead-free vitreous bond precursor may be a frit, which when heated to a high temperature in the firing step melts and/or fuses to form the vitreous bond of the abrasive article. Various combinations of materials well known in the art may be used as the lead-free vitreous bond precursor. Primarily such materials are metallic oxides and silicates. Preformed, lead-free, fine particle glasses (i.e. frits) made from various combinations of oxides and silicates may be used as the vitreous bond precursor material in this invention. Such frits are commonly known in the art and are commercially available. These frits are generally made by first preparing a combination of oxides and silicates that is heated to a high temperature to form a glass. The glass, after being cooled, is then broken into small particles. There may be used in the practice of this invention a combination of frit and an unfired admixture of oxides and silicates as the vitreous bond precursor material as long as the combination is free of lead.

In accordance with this invention there can be employed in the vitreous bond precursor-abrasive admixture a metal boride modified, lead-free, vitreous particulate material as the lead-free, vitreous bond precursor. This particulate material may be made, for example, by forming an intimately mixed admixture of metal boride (e.g. zirconium boride) powder and a lead-free, vitreous bond precursor material, heating the admixture to a high temperature (e.g. 500° C. to 1000° C.) in an oxidizing atmosphere (e.g. air) to form a glass and upon cooling the glass breaking it into fine particles. Vitreous bond precursor materials such as various metal oxides and silicates that are well known in the art may be used to produce the vitreous particulate. Various metal boride powders may be used as the metal boride modifier in producing the metal boride modified, lead-free, vitreous particulate material. Borides of metals including, but not limited to, calcium, titanium, zirconium, chromium, molybdenum, tungsten, nickel, aluminum and silicon may be used, preferably borides of calcium, titanium and zirconium. The fine particles of such vitreous particulate material, when used in the vitreous bond precursor-abrasive admixture, melt and/or fuse together during the firing step to form the vitreous bond binding together the abrasive grain of the vitreous bonded abrasive article. The metal boride modified, lead-free, vitreous particulate material of the vitreous bond precursor-abrasive admixture of this invention may also be prepared using metal boride modified lead-free frit. Such lead-free vitreous bond particulate material may be made by admixing a metal boride powder with lead free frit, heating the admixture to a fusing or melting temperature in an oxidizing (e.g. air) atmosphere to form a glass, cooling the glass and then breaking the glass into fine particles. It is contemplated in accordance with this invention that there may be used as the vitreous bond precursor material: (i) admixtures of lead free frit and such metal boride modified, lead-free, vitreous particulate materials, including those produced from metal boride modified, lead-free, frit; (ii) admixtures of such lead-free vitreous particulate materials, including those produced from metal boride modified, lead-free, frit, and various lead free metal oxides and silicates that are well known in the art; and, (iii) admixtures of such lead-free vitreous particulate materials, including those produced from metal boride modified, lead-free, frit; lead free frit; and, various lead free metal oxides and silicates well known in the art.

Temperatures in the range of about 1000° F. to about 2500° F. may be used in the practice of this invention for converting the vitreous bond precursor to the vitreous bond binding together the abrasive grains of the abrasive article (e.g. grinding wheel).

Various abrasive grains or grits or combinations of abrasive grains of conventional sizes well known in the art may be employed in the practice of this invention. Such abrasive grains may be of a single composition, structure and size or may be of more than one composition, structure and size. The abrasive grit may be made by a sol-gel process, sintered sol-gel process or by a process other than a sol-gel process (e.g. fused abrasive grains). Mixtures of two or more abrasive grains of different sizes and/or composition may be used. Abrasive grains usable in the practice of this invention include, but are not limited to, sintered sol-gel alumina such as sold under the trade name "CUBITRON", available from the Minnesota Mining and Manufacturing Company ("CUBITRON" is a registered trademark of the Minnesota Mining and Manufacturing Company), sol-gel aluminum nitride/aluminum oxynitride as has been described in U.S. Pat. No. 4,788,167, fused alumina, zirconia, co-fused alumina/zirconia, silicon carbide, cubic boron nitride, tungsten carbide, titanium carbide, zirconium carbide, tungsten nitride, titanium nitride and zirconium nitride. Abrasive grain particle sizes as are well known and employed in the art are usable in the practice of this invention.

There is required in accordance with this invention that the vitreous bond precursor-abrasive admixture comprise either at least one metal boride powder or a metal boride modified, lead-free, vitreous particulate material as described herein. More than one metal boride powder may be used in the practice of this invention. Metal boride powders usable in the practice of this invention include, but are not limited to, borides of copper, calcium, strontium, barium, aluminum, cesium, silicon, titanium, zirconium, chromium, tungsten, molybdenum, iron, cobalt and nickel, more particularly the borides of calcium, titanium, zirconium, tungsten and molybdenum and still more particularly the borides of calcium, titanium, zirconium and tungsten. The metal boride powder employed in the practice of this invention has a particle size substantially smaller, preferably very much smaller, than the particle size of the abrasive grains employed in the practice of this invention. In the practice of this invention there can be employed metal boride powders having an average particle size in the range of from about 1 micron to about 40 microns, preferably from about 10 microns to about 20 microns.

The metal boride powder usable in the practice of this invention modifies the vitreous bond, as contrasted to functioning as an abrasive. Hence, the metal boride powder may be employed in an amount that can vary widely with the chemical and physical properties of the metal boride powder, the chemical and physical properties of the other lead-free vitreous bond precursor constituents, as well as the amounts of lead-free vitreous bond precursor and abrasive grain employed in producing the vitreous bonded abrasive article. Generally the amount of the metal boride powder employed in the practice of this invention may be in the range of from about 5 weight percent to about 90 weight percent, preferably from about 15 weight percent to about 75 weight percent, of the total weight of the non metal boride constituents (i.e. those constituents that are not a metal boride) of the lead-free vitreous bond precursor material.

Various other materials or substances (i.e. additives) well known in the art may be added to the vitreous bond precursor-abrasive admixture in the practice of this invention in amounts conventional to the art. Such other materials or substances include, but are not limited to lubricants, including solid lubricants such as graphite, extreme pressure agents, waxes, pore inducers, grinding aids and fillers. Grinding aids such as, for example, mullite, kyanite, cryolite and syenite may be employed in the practice of this invention.

In the practice of one aspect of this invention there is combined in the vitreous bonded abrasive precursor admixture a temporary binder that may be an organic or inorganic material. Commonly, organic temporary binders are employed, such as, for example, phenolic resins. These binders bind together the components of the vitreous bond precursor-abrasive admixture sufficiently so that the formed article is self-supporting before firing. Various organic temporary binders suitable for use in the practice of the invention include, for example, organic polymeric materials or polymer forming materials. Phenolic resins, known in the art to be useful temporary binders, may be used in the practice of the invention.

In the step of preparing the vitreous bond precursor-abrasive admixture in the method of this invention there may be employed conventional blending techniques, conditions and equipment well known in the art. The lead-free vitreous bond precursor material, temporary binder, abrasive grain and, when used, metal boride powder, may be combined in various orders to produce the admixture. Abrasive grain may be blended with the lead-free vitreous bond precursor material, and the metal boride powder may then be blended with the resulting mixture followed by the addition thereto of a temporary binder material and optionally other additives (e.g. pore induces). Often it is desirable to blend in the temporary binder material last, particularly if the preferred temporary binder is volatile and the vitreous bond precursor-abrasive admixture is expected to be stored for any significant period before use in production of abrasive articles. However there may be instances where it is convenient or desirable to blend in the temporary binder material earlier in the step of preparing the vitreous bond precursor-abrasive admixture. Alternatively, the metal boride powder may be blended with the lead-free vitreous bond precursor material followed by the addition of the abrasive grain and then the blending in of the temporary binder material. Although use of a temporary binder material is contemplated by this invention it is likewise contemplated that a temporary binder could be omitted in instances, for example, where firing of the green article could be carried out within a mold.

In the practice of the method of this invention an abrasive article (e.g. grinding wheel) is formed from the vitreous bond precursor-abrasive admixture. Typically, a measured amount of the vitreous bond precursor-abrasive admixture is placed in a mold defining the desired shape and overall size of an article. The admixture is compressed within the mold and air-dried and/or heated to remove any volatile materials. The compressing, drying and heating of the admixture contribute to binding of the components of the admixture by the temporary binder, if any. Heating at this step of the method will be below the temperature for converting the lead-free vitreous bond precursor material into a vitreous bond or matrix, the actual temperature established according to the nature of the temporary binder and various other components of the admixture. Suitable temperatures for such heating are, for example, from about 200° to about 300° C. Sufficient compressing, drying and selectively, heating, are typically carried out to bind the admixture components sufficiently to produce a self-supporting but unfired compact, referred to in the art as a "green" article (e.g. "green wheel").

In accordance with the method of this invention, the green compact formed with the vitreous bond precursor-abrasive admixture is fired to form the vitreous matrix binding the abrasive grain. Such firing generally involves heating the green abrasive article to a high temperature in air in accordance with a time/temperature cycle carried out within a kiln. Temperatures ranging from about 500° C. to about 1200° C. may be employed in the firing step in the practice of the method of this invention.

The particular firing conditions (i.e. time and temperatures) employed in the firing step of the method of this invention will be influenced by such factors as, for example, the composition of the abrasive grain; the composition of the lead-free vitreous bond precursor material; and, the size and shape of the abrasive article (e.g. grinding wheel). In carrying out the firing step of the method of this invention various heating techniques, known in the art, may be employed. Such techniques, also known as "firing conditions", may include for example, heating the green abrasive article by a stepwise increase in temperature with specific time periods at each step to a plateau (i.e. constant) temperature, holding the plateau temperature for a specific time and then heating to a higher temperature or cooling the abrasive article in a stepwise or continuously decreasing temperature pattern to room temperature. Alternatively the green abrasive article may be heated, in the firing step, at some constant rate of temperature increase (e.g. 50° per hour) to a maximum temperature that may be held for a specific period of time or to a maximum temperature after which cooling of the abrasive article to room temperature takes place. The firing step includes both a heating and cooling regimen, both of which may be carried out in various manners known to the art.

A particular advantage of one aspect of the method of this invention is that the firing step can be carried out in an oxidizing atmosphere, eliminating the need, known from the prior art, of providing an inert or non-oxidizing atmosphere to vitrify the bond. Commonly such oxidizing atmosphere will be an air atmosphere. During the firing step various organic materials present in the green abrasive article (e.g. resinous temporary binders, organic pore inducers etc.) are usually burned off or physically or chemically altered by the high temperatures used in the firing step.

In the method of this invention wherein a metal boride modified, lead-free, vitreous particulate material, produced as described herein, comprises the vitreous bond precursor, the firing step of the green abrasive article can be carried out in an oxidizing or non oxidizing atmosphere. It is preferred to use such metal boride modified, lead-free, vitreous particulate materials as the entire vitreous particulate material in the vitreous bond precursor-abrasive admixture. However, such vitreous particulate material can be used together with a lead-free, vitreous bond particulate material not modified with a metal boride and/or an admixture of lead-free metal oxides and silicates, that are well known in the art, with or without a metal boride powder present.

The cause or causes for the enhanced performance of vitreous bonded abrasive articles, e.g. grinding wheels, produced in accordance with the method and the vitreous bond precursor-abrasive admixture of this invention are not known. However, visual observations and preliminary instrumental investigations indicate that the metal boride powder undergoes physical and/or chemical changes during the firing of the lead-free vitreous bond precursor material in an oxidizing atmosphere (e.g. oxygen) and that such changes are minimal or do not occur when firing such lead-free vitreous bond precursor material in an inert (e.g. nitrogen) atmosphere. These observations and investigations also appear to indicate that the metal boride powder may interact with one or more components of the lead-free vitreous bond precursor material in the presence of an oxidizing (e.g. oxygen) atmosphere to chemically and/or physically modify the vitreous matrix. The resulting metal boride modified, lead-free vitreous matrix forms bonded abrasive articles exhibiting improved performance as compared to abrasive articles known in the prior art.

This invention will now be further described with reference to the following examples. These examples demonstrate various practices of this invention and are not intended to be limiting on the scope and embodiments of the invention disclose and claimed herein. In the following examples all parts and percentages are by weight unless otherwise indicated, all temperatures are in degree Fahrenheit unless otherwise indicated and mesh sizes are in U.S. Standard Sieve sizes.

In the examples below the lead-free vitreous bond precursor material identified as Bond A has the following nominal weight percent composition:

| Component | Weight % |
|---|---|
| "FERRO" SG 613A glass frit | 89.5 |
| Alumina powder | 7.0 |
| Titanium dioxide | 3.5 |

Bond A is prepared by thoroughly blending together the glass frit, alumina powder and titanium dioxide into a uniform blend. "FERRO" SG 613 A glass frit is commercially available from the Ferro Corporation. "FERRO" is a registered trademark of the Ferro Corporation.

3029 resin used in the examples below is a temporary binder material having 65% by weight solid urea formaldehyde resin and 35% by weight water.

Examples 1 to 8 below pertain to vitreous bonded abrasive bars having nominal dimensions of 0.250×0.254×1.560 inches made for physical examination and properties evaluation. The bars were prepared in the following manner using the material and amounts (i.e. % by weight) shown in the examples. Bond A lead-free vitreous bond precursor material and dextrin were thoroughly blended together. Metal boride powder, where employed, was added to and thoroughly blended into the Bond A lead-free vitreous bond precursor material—dextrin blend to produce a uniform mixture. Cubic boron nitride abrasive grain was mixed and thoroughly blended with the AGRASHELL organic particulate and the 3029 resin to produce a uniform mixture ("AGRASHELL" is a registered trademark of Agrashell Inc.). The mixture of abrasive grain, AGRASHELL organic particulate and 3029 resin was then added to and blended with the mixture of Bond A, dextrin and where employed metal boride powder to form a uniform blend. This uniform blend or formulation was then measured into a mold cavity having the nominal dimension of 0.254 by 1.56 inches and variable depth and pressed to a nominal thickness of 0.250 inches. The pressed bar having nominal dimensions of 0.250×0.254×1.56 inches was removed from the mold and dried for at least one hour at room temperature. Thereafter the bar was measured and then fired in a furnace by heating it from room temperature to 200° F. in 10 minutes then increasing the temperature at a rate of 100° F. per hour to 700° F. and thereafter increasing the temperature at a rate of 50° F./hour to 1500° F. and holding the bar at 1500° F. for 3 hours whereupon it was allowed to gradually cool to room temperature in the furnace with the furnace turned off.

The volume percent change given in Examples 1 to 8 was determined in accordance with a well known standard procedure and calculations described in Chapter IV, pages 27 to 42 of Ceramic Tests and Calculations by A. I. Andrews, published by John Wiley & Sons Inc., copyrighted 1948. Shrinkage of the bar during firing is indicated by negative values.

EXAMPLES

Vitreous bonded abrasive bar examples

| Component | Example Number 1 | 2 | 3 | 4 | 5 | 6 |
|---|---|---|---|---|---|---|
| Cubic boron nitride (170/200 mesh) | 66.79 | 60.82 | 60.82 | 60.82 | 63.68 | 63.68 |
| Calcium hexaboride (<45 microns*) | — | 8.94 | — | — | — | — |
| Titanium diboride (13 microns*) | — | — | 8.94 | — | 4.66 | — |
| Titanium diboride (4 microns*) | — | — | — | — | — | 4.66 |
| Zirconium diboride (13 microns*) | — | — | — | 8.94 | — | — |
| Bond A (<45 microns*) | 19.04 | 17.34 | 17.34 | 17.34 | 18.16 | 18.16 |
| Dextrin | 2.14 | 1.95 | 1.95 | 1.95 | 2.04 | 2.04 |
| 3029 Resin | 5.71 | 5.20 | 5.20 | 5.20 | 5.44 | 5.44 |
| Agrashell (100/200 mesh) | 6.32 | 5.75 | 5.75 | 5.75 | 6.02 | 6.02 |

*average particle size

| Component | Example Number 7 | 8 |
|---|---|---|
| Cubic boron nitride (170/200 mesh) | 58.59 | 66.16 |
| Calcium hexaboride (38 microns*) | 15.03 | — |
| Titanium diboride (4 microns*) | — | 0.94 |
| Zirconium diboride (13 microns*) | — | — |
| Bond A (13 microns*) | 16.71 | 18.86 |
| Dextrin | 1.88 | 2.12 |
| 3029 Resin | 5.01 | 5.66 |
| Agrashell (100/200 mesh) | 2.78 | 6.26 |

*average particle size

Vitreous Bonded Abrasive Bars

Vitreous bonded abrasive bars were made with the formulations of Examples 1 to 8 in accordance with the procedure previously described herein and tested for physical properties [i.e. modulus of rupture (MOR) and modulus of elasticity (MOE)] in accordance with well known standard procedures as well as examined for volume % by change by the method described herein. The results of the physical tests and examination are given in the following table.

| Abrasive Bar Formulation | MOR (PSI) | MOE ($\times 10^6$PSI) | Vol. % Change |
|---|---|---|---|
| Example No. 1 | 6,053 | 11.03 | −2 |
| Example No. 2 | 8,710 | 15.09 | 0 |
| Example No. 3 | 9,664 | 15.64 | −1 |
| Example No. 4 | 10,358 | 14.27 | −1 |
| Example No. 5 | 9,353 | 14.85 | −2 |
| Example No. 6 | 9,122 | 13.76 | −2 |
| Example No. 7 | 10,733 | 17.70 | 0 |
| Example No. 8 | 7,776 | 12.90 | −4 |

Vitreous Bonded Abrasive Grinding Wheels

The formulations of Examples 1,4,7, and 8 were made into vitreous bonded abrasive grinding wheel rims. Each wheel rim initially had a nominal outside diameter of 5.0 inches, a nominal thickness of 0.25 inches and a nominal inside diameter of 4.5 inches. The grinding wheel rims below were prepared in the same manner as the abrasive bars of Examples 1 to 8 as respects the mixing of the formulation components and the heating schedule for firing the pressed compact. The mold used for forming the grinding wheel rims had a cavity to produce a grinding wheel rim having the stated nominal dimensions. Thoroughly mixed components of the indicated formulations were measured into the appropriate mold cavity and pressed to the nominal wheel rim dimensions stated. The pressed wheel rim was then removed from the mold and air dried for at least one hour, whereupon the wheel rim was fired to vitrify the bond.

Each vitreous bonded abrasive wheel rim was adhered to an aluminum metal core having a nominal outside diameter of 4.5 inches, a nominal thickness of 0.25 inches and a nominal inside diameter of 1.25 inches to produce the grinding wheels of Examples 9 to 12. The grinding wheels thus prepared were then tested for grinding performance. The grinding tests were conducted by mounting grinding wheels of Examples 9 to 12 on a surface grinder to grind a workpiece of M-2 steel. Grinding was performed at a wheel speed of 5300 surface feet per minute, an infeed (feed toward the workpiece) per pass of 0.001 inches, and a table speed of 50 inches per minute. CIMTECH 100 aqueous based metalworking fluid was applied to the tool-workpiece interface during each test ("CIMTECH" is a registered trademark of Milacron Inc.). Measurements were made of the grinding wheel and the workpiece before and after the test to determine the volume of wheel lost and volume of workpiece material removed. The reported G-ratio values were computed from these measurements. Higher values of G-ratio represent better grinding wheel performance. Results of the grinding test are given in the following table:

| Grinding Wheel | Formulation | G-ratio |
|---|---|---|
| Example No. 9 | Example No. 1 | 11.00 |
| Example No. 10 | Example No. 4 | 44.15 |
| Example No. 11 | Example No. 7 | 39.33 |
| Example No. 12 | Example No. 8 | 38.98 |

What is claimed is:

1. A method of making a vitreous bonded abrasive article comprising the steps of:

a) preparing a vitreous bond precursor-abrasive admixture comprising vitreous bond precursor and abrasive grains, the abrasive grains selected from the group consisting essentially of sintered sol-gel alumina, sol-gel aluminum nitride/aluminum oxynitride, fused alumina, zirconia, co-fused alumina/zirconia, silicon carbide, cubic boron nitride, tungsten carbide, titanium carbide, zirconium carbide, tungsten nitride titanium nitride and zirconium nitride and mixtures thereof, the admixture, when fired producing a metal boride modified, lead-free vitreous matrix binding the abrasive grains, the metal boride modification resulting from firing in an oxidizing atmosphere;

b) forming the admixture into a green abrasive article and c) firing the green abrasive article.

2. The method of claim 1 wherein the vitreous bond precursor comprises a lead-free vitreous bond precursor material and metal boride powder and the green abrasive article is fired in an oxidizing atmosphere.

3. The method of claim 2 wherein the oxidizing atmosphere is air.

4. The method of claim 2 wherein the metal of the metal boride powder is selected from the group consisting of calcium, titanium, zirconium, chromium, molybdenum, tungsten, nickel, aluminum and silicon.

5. The method of claim 3 wherein the lead-free vitreous bond precursor material is a frit.

6. A vitreous bonded abrasive article produced in accordance with the method of claim 2.

7. A vitreous bonded abrasive grinding wheel made in accordance with the method of claim 2.

8. The method of claim 1 wherein the vitreous bond precursor comprises a metal boride modified, lead-free, vitreous particulate material.

9. The method of claim 8 wherein the metal of the metal boride modified, lead-free, vitreous particulate material is selected from the group consisting of calcium, titanium, zirconium, chromium, molybdenum, tungsten, nickel, aluminum and silicon.

10. The method of claim 9 wherein the green abrasive article is fired in air.

11. The method of claim 8 wherein the metal boride modified, lead-free vitreous particulate material is made from a vitreous material produced by firing an admixture of metal boride powder and a lead-free, vitreous bond precursor material in an oxidizing atmosphere.

12. The method of claim 11 wherein the vitreous bond precursor material comprises lead-free frit.

13. A vitreous bonded abrasive article produced in accordance with the method of claim 8.

14. A vitreous bonded abrasive article produced in accordance with the method of claim 9.

15. A vitreous bonded abrasive article produced in accordance with the method of claim 10.

16. A vitreous bonded abrasive grinding wheel produced in accordance with the method of claim 10.

17. A vitreous bond precursor-abrasive admixture for use in making vitreous bonded abrasive articles, the admixture comprising abrasive grain and a metal boride modified, lead-free, vitreous particulate material, the metal boride modification resulting from firing in an oxidizing atmosphere, the abrasive grain selected from the group consisting essentially of sintered sol-gel alumina, sol-gel aluminum nitride/aluminum oxynitride, fused alumina, zirconia, co-fused alumina/zirconia, silicon carbide, cubic boron nitride, tungsten carbide, titanium carbide, zirconium carbide, tungsten nitride, titanium nitride and zirconium nitride and mixtures thereof.

18. The vitreous bond precursor-abrasive admixture of claim 17 where in the metal of the metal boride modified, lead-free, vitreous particulate material is selected from the group consisting of calcium, titanium, zirconium, chromium, molybdenum, tungsten, nickel, aluminum and silicon.

19. The vitreous bond precursor-abrasive admixture of claim 18 further comprising a temporary binder.

20. A vitreous bonded abrasive article comprising a metal boride modified, lead free vitreous matrix and abrasive grain bound by the metal boride modified vitreous matrix, the abrasive grain selected from the group consisting essentially of sintered sol-gel alumina, sol-gel aluminum nitride/aluminum oxynitride, fused alumina, zirconia, co-fused alumina/zirconia, silicon carbide, cubic boron nitride, tungsten carbide, titanium carbide, zirconium carbide, tungsten nitride, titanium nitride and zirconium nitride and mixtures thereof, the metal boride modification resulting from firing in an oxidizing atmosphere.

21. The vitreous bonded abrasive article of claim 20 wherein the article is a grinding wheel.

22. The grinding wheel of claim 21 wherein the abrasive grain comprises at least two different abrasives.

23. The vitreous bonded abrasive article of claim 20 further comprising a filler.

24. The vitreous bonded abrasive article of claim 20 further comprising grinding aids.

25. The vitreous bonded abrasive article of claim 20 further comprising extreme pressure agents.

26. The vitreous bonded abrasive article of claim 20 further comprising a lubricant.

27. The vitreous bonded abrasive article of claim 26 wherein the lubricant is graphite.

* * * * *